US005829863A

United States Patent [19]

Gutshall

[11] Patent Number: 5,829,863

[45] Date of Patent: Nov. 3, 1998

[54] FIBER OPTIC X-MAS TREE

[76] Inventor: David Gutshall, 71 Woodvale Ave., Johnstown, Pa. 15901

[21] Appl. No.: 906,120

[22] Filed: Jul. 25, 1997

[51] Int. Cl.[6] ..... F21P 1/02

[52] U.S. Cl. ..... 362/123; 362/32; 362/86; 362/293; 362/806

[58] Field of Search ..... 362/32, 86, 123, 362/293, 806

[56] References Cited

U.S. PATENT DOCUMENTS

| | | | |
|---|---|---|---|
| 3,766,376 | 10/1973 | Sadacca et al. | 40/433 |
| 5,213,407 | 5/1993 | Eisenbraun | 362/123 |
| 5,702,170 | 12/1997 | Broderick | 362/32 |

*Primary Examiner*—Stephen F. Husar

[57] ABSTRACT

A fiber optic Christmas tree is provided including a housing with a base and a trunk. The trunk has a first end fixedly coupled to the top face of the base and is extended upwardly therefrom. The trunk has a plurality of bores formed therein. Next provided is a plurality of fiber optic cables each having a first end situated within the interior space of the base and a second end extending through an associated one of the bores of the trunk. A length of each cord is such that an extent to which the fiber optic cables extend from the trunk increases from a top of the trunk to a bottom thereof. The fiber optic cables thus have a conical configuration. Each of the fiber optic cables is adapted to emit light from the second thereof upon the application of light at the first end thereof. A lamp is situated below the fiber optic cables within the interior space of the housing and adapted to apply light to the first end of each of the fiber optic cables upon the receipt of power. A power source is connected to the lamp.

5 Claims, 1 Drawing Sheet

FIG. 1
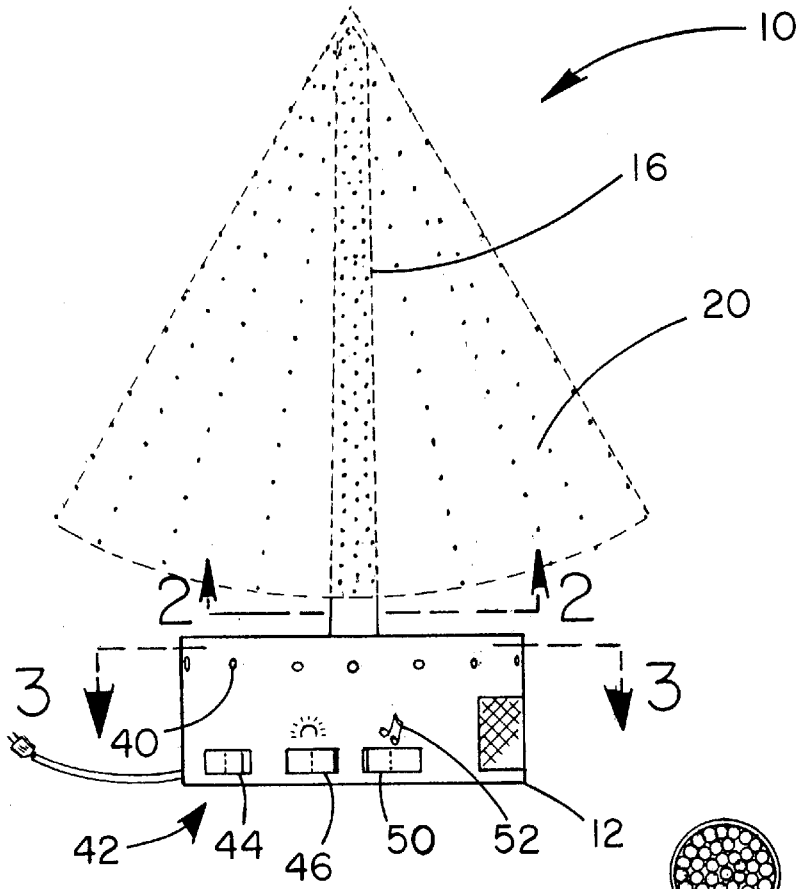
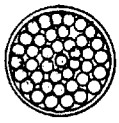
FIG. 2
FIG. 3
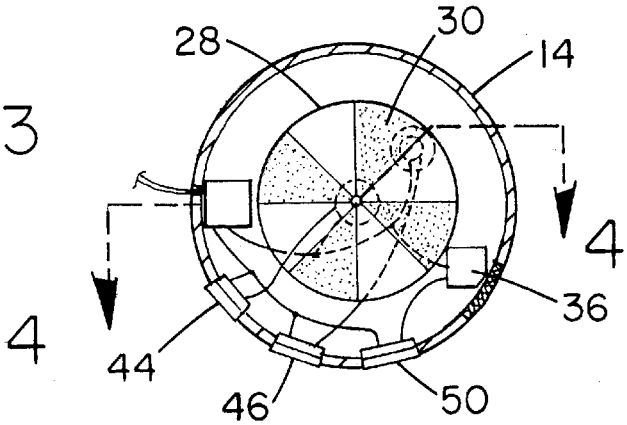
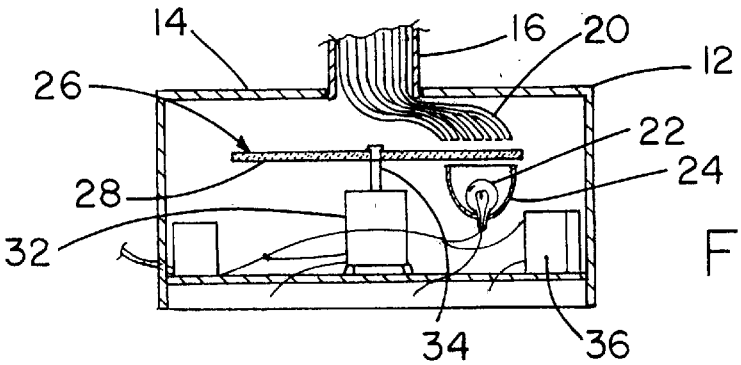
FIG. 4

FIBER OPTIC X-MAS TREE

BACKGROUND OF THE INVENTION

1. Field of the Invention

The present invention relates to fiber optic Christmas Trees and more particularly pertains to a new FIBER OPTIC X-MAS TREE for providing a conical shaped fiber optic tree adapted to emit light and a jingle during use.

2. Description of the Prior Art

The use of Christmas Trees is known in the prior art. More specifically, Christmas Trees heretofore devised and utilized are known to consist basically of familiar, expected and obvious structural configurations, notwithstanding the myriad of designs encompassed by the crowded prior art which have been developed for the fulfillment of countless objectives and requirements.

Known prior art Christmas Trees include U.S. Pat. No. 5,422,797; U.S. Pat. No. 5,104,608; U.S. Pat. No. 4,858,086; U.S. Pat. No. 4,068,118; U.S. Pat. No. 4,060,722; and U.S. Pat. No. 5,333,226.

In these respects, the FIBER OPTIC X-MAS TREE according to the present invention substantially departs from the conventional concepts and designs of the prior art, and in so doing provides an apparatus primarily developed for the purpose of providing a conical shaped fiber optic tree adapted to emit light and a jingle during use.

SUMMARY OF THE INVENTION

In view of the foregoing disadvantages inherent in the known types of Christmas Trees now present in the prior art, the present invention provides a new FIBER OPTIC X-MAS TREE construction wherein the same can be utilized for providing a conical shaped fiber optic tree adapted lo emit light and a jingle during use.

The general purpose of the present invention, which will be described subsequently in greater detail, is to provide a new FIBER OPTIC X-MAS TREE apparatus and method which has many of the advantages of the Christmas Trees mentioned heretofore and many novel features that result in a new FIBER OPTIC X-MAS TREE which is not anticipated, rendered obvious, suggested, or even implied by any of the prior art Christmas Trees, either alone or in any combination thereof.

To attain this, the present invention generally comprises a housing including a base with a cylindrical configuration. The housing has a circular top face, a circular bottom face, and an annular periphery formed therebetween defining an interior space. The housing further includes a trunk with a tubular configuration having a first end fixedly coupled to the top face of the base and a second end extended upwardly therefrom. For reasons that will become apparent hereinafter, the trunk has a plurality of bores formed therein. Next provided is a plurality of fiber optic cables each having a first end situated within the interior space of the base and a second end extending through an associated one of the bores of the trunk. A length of each cord is such that an extent to which the fiber optic cables extend from the trunk increases from a top of the trunk to a bottom thereof. As shown in FIG. 1, the fiber optic cables have a conical configuration. Each of the fiber optic cables is adapted to emit light from the second thereof upon the application of light at the first end thereof. Situated below the fiber optic cables within the interior space of the housing is a lamp. The lamp is adapted to apply light to the first end of each of the fiber optic cables upon the receipt of power. For focusing light on the fiber optic cables, the lamp includes a hemispherical reflector mounted about the bulb. A color wheel assembly is provided. The color wheel assembly includes a translucent disc positioned between the lamp and the first end of each of the fiber optic cables. The translucent disc has a plurality of pie-shaped sections each having a color different to that of an adjacent section. Note FIG. 3. The color wheel assembly further includes a motor mounted to the bottom face of the base within the interior space of the housing. A rotor of the motor is coaxially oriented with respect to the trunk of the housing. During use, the motor is adapted to effect the rotation of the disc such that various colors are seen at the second ends of the fiber optic cables as a function of time upon the receipt of power. Positioned within the base of the housing is a music box for emitting an audible jingle upon the receipt of power. A plurality of apertures are formed in the periphery of the base of the housing. Next provided is an electrical switching assembly. Such network includes a first switch connected between the motor and a power source. Further provided is a third switch connected between the lamp and the power source and a third switch connected between the music box and the power source.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new FIBER OPTIC X-MAS TREE apparatus and method which has many of the advantages of the Christmas Trees mentioned heretofore and many novel features that result in a new FIBER OPTIC X-MAS TREE which is not anticipated, rendered obvious, suggested, or even implied by any of the prior art Christmas Trees, either alone or in any combination thereof.

It is another object of the present invention to provide a new FIBER OPTIC X-MAS TREE which may be easily and efficiently manufactured and marketed.

It is a further object of the present invention to provide a new FIBER OPTIC X-MAS TREE which is of a durable and reliable construction.

An even further object of the present invention is to provide a new FIBER OPTIC X-MAS TREE which is susceptible of a low cost of manufacture with regard to both materials and labor, and which accordingly is then susceptible of low prices of sale to the consuming public, thereby making such FIBER OPTIC X-MAS TREE economically available to the buying public.

Still yet another object of the present invention is to provide a new FIBER OPTIC X-MAS TREE which provides in the apparatuses and methods of the prior art some of the advantages thereof, while simultaneously overcoming some of the disadvantages normally associated therewith.

Still another object of the present invention is to provide a new FIBER OPTIC X-MAS TREE for providing a conical shaped fiber optic tree adapted lo emit light and a jingle during use.

Even still another object of the present invention is to provide a new FIBER OPTIC X-MAS TREE that includes a housing with a base and a trunk. The trunk has a first end fixedly coupled to the top face of the base and is extended upwardly therefrom. The trunk has a plurality of bores formed therein. Next provided is a plurality of fiber optic cables each having a first end situated within the interior space of the base and a second end extending through an associated one of the bores of the trunk. A length of each cord is such that an extent to which the fiber optic cables extend from the trunk increases from a top of the trunk to a bottom thereof. The fiber optic cables thus have a conical configuration. Each of the fiber optic cables is adapted to emit light from the second thereof upon the application of light at the first end thereof. A lamp is situated below the fiber optic cables within the interior space of the housing and adapted to apply light to the first end of each of the fiber optic cables upon the receipt of power. A power source is connected to the lamp.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side view of a new FIBER OPTIC X-MAS TREE according to the present invention.

FIG. 2 is a cross-sectional top view of the trunk of the present invention.

FIG. 3 is a cross-sectional top view of the base of the present invention.

FIG. 4 is a cross-sectional side view of the base of the present invention.

DESCRIPTION OF THE PREFERRED EMBODIMENT

With reference now to the drawings, and in particular to FIGS. 1 through 4 thereof, a new FIBER OPTIC X-MAS TREE embodying the principles and concepts of the present invention and generally designated by the reference numeral 10 will be described.

As shown in the various Figures, a housing 12 is provided including a base 14 with a cylindrical configuration. The housing has a circular top face, a circular bottom face, and an annular periphery formed therebetween defining an interior space. The housing further includes a trunk 16 with a tubular configuration having a first end fixedly coupled to the top face of the base and a second end extended upwardly therefrom. For reasons that will become apparent hereinafter, the trunk has a plurality of bores formed therein. In the preferred embodiment, the bores are evenly spaced and formed about the entire surface of the trunk.

Next provided is a plurality of clear fiber optic cables 20 each having a first end situated within the interior space of the base and a second end extending through an associated one of the bores of the trunk. In the base, the first ends of the cables are bunched together and offset from the trunk. A length of each cord is such that an extent to which the fiber optic cables extend from the trunk increases from a top of the trunk to a bottom thereof. As shown in FIG. 1, the fiber optic cables have a conical configuration. Each of the fiber optic cables is adapted to emit light from the second thereof upon the application of light at the first end thereof.

Situated below the fiber optic cables within the interior space of the housing is a lamp 22. The lamp is adapted to apply light to the first end of each of the fiber optic cables upon the receipt of power. For focusing light on the fiber optic cables, the lamp includes a hemispherical reflector 24 mounted about the bulb.

A color wheel assembly 26 is provided. The color wheel assembly includes a translucent disc 28 positioned between the lamp and the first end of each of the fiber optic cables. The translucent disc has a plurality of pie-shaped sections 30 each having a color different to that of an adjacent section. Note FIG. 3. The color wheel assembly further includes a motor 32 mounted to the bottom face of the base within the interior space of the housing. A rotor 34 of the motor is coaxially oriented with respect to the trunk of the housing. During use, the motor is adapted to effect the rotation of the disc such that various colors are seen at the second ends of the fiber optic cables as a function of time upon the receipt of power.

Positioned within the base of the housing is a music box 36 for emitting an audible jingle upon the receipt of power. Such jingle is ideally a Christmas song or the like. So that the jingle may be heard exterior of the base, a grid 38 is formed in the periphery of the base adjacent the music box.

For venting any heat generated by the lamp, a plurality of apertures 40 are formed in the periphery of the base of the housing. Preferably, such apertures are formed about the entire periphery of the base at a common short distance from the top face thereof.

Next provided is an electrical switching assembly 42. Such network includes a first switch 44 connected between the motor and a power source. Further provided is a second switch 46 connected between the lamp and the power source and a third switch 50 connected between the music box and the power source. As such, the respective switches must be closed for the motor, lamp, and music box to function. In the preferred embodiment, the switches are positioned in linear alignment along the periphery of the base adjacent the bottom face thereof each with indicia 52 indicative of its operation printed adjacent thereto.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fiber optic Christmas tree comprising, in combination:

a housing including a base with a cylindrical configuration having a circular top face, a circular bottom face, and an annular periphery formed therebetween defining an interior space, the housing further including a trunk with a tubular configuration having a first end fixedly coupled to the top face of the base and extending upwardly therefrom, the trunk having a plurality of bores formed therein, wherein the bores are evenly spaced and formed about an entire surface of the trunk;

a plurality of fiber optic cables each having a first end situated within the interior space of the base and a second end extending through an associated one of the bores of the trunk, a length of each cable being such that an extent to which the fiber optic cables extend from the trunk increases from a top of the trunk to a bottom thereof, wherein the fiber optic cables have a conical configuration, each of the fiber optic cables adapted to emit light from the second thereof upon the application of light at the first end thereof, wherein the first ends of the cables are bunched together in the base and offset from the trunk;

a lamp situated below the fiber optic cables within the interior space of the housing and adapted to apply light to the first end of each of the fiber optic cables upon the receipt of power, the lamp including a hemispherical reflector mounted about the bulb for focusing light on the fiber optic cables, wherein the lamp is offset from the trunk of the housing;

a color wheel assembly including a translucent disc positioned between the lamp and the first end of each of the fiber optic cables in coaxial relationship with the trunk, the translucent disc having a plurality of pie-shaped sections each having a color different from that of an adjacent section, the color wheel assembly further including a motor mounted to the bottom face of the base within the interior space of the housing, a rotor of the motor being coaxially oriented with respect to the trunk of the housing, the motor adapted to effect the rotation of the disc such that various colors are seen at the second ends of the fiber optic cables as a function of time upon the receipt of power;

a music box positioned within the base of the housing for emitting an audible jingle upon the receipt of power, wherein a grid is formed in the periphery of the base adjacent the music box so that the jingle may be heard exterior of the housing;

a plurality of apertures formed in the periphery of the base of the housing for venting heat, wherein the apertures are formed about the entire periphery of the base at a common distance from the top face thereof; and an electrical switching assembly including a first switch connected between the motor and a power source, a second switch connected between the lamp and the power source, and a third switch connected between the music box and the power source, wherein the switches are positioned in linear alignment along the periphery of the base adjacent the bottom face thereof each with indicia indicative of its operation printed adjacent thereto.

2. A fiber optic Christmas tree comprising:

a housing including a base and a trunk with a tubular configuration having a first end fixedly coupled to a top face of the base and extending upwardly therefrom, the trunk having a plurality of bores formed therein;

a plurality of fiber optic cables each having a first end situated within the interior space of the base and a second end extending through an associated one of the bores of the trunk, a length of each cable being such that an extent to which the fiber optic cables extend from the trunk increases from a top of the trunk to a bottom thereof, wherein the fiber optic cables have a conical configuration, each of the fiber optic cables adapted to emit light from the second thereof upon the application of light at the first end thereof, wherein the first ends of the cables are bunched together in the base and offset from the trunk;

a lamp situated below the fiber optic cables within the interior space of the housing and adapted to apply light to the first end of each of the fiber optic cables upon the receipt of power, wherein the lamp is offset from the trunk of the housing;

power means connected to the lamp; and a color wheel assembly with a translucent disc positioned between the lamp and the first end of each of the fiber optic cables in coaxial relationship with the trunk, wherein the disc of the color wheel assembly is adapted to rotate and has a plurality of pie-shaped sections each having a color different from that of an adjacent section.

3. A fiber optic Christmas tree as set forth in claim 2 wherein the lamp includes a hemispherical reflector mounted about the bulb for focusing light on the fiber optic cables.

4. A fiber optic Christmas tree as set forth in claim 2 and further including a music box for emitting an audible jingle upon the receipt of power, wherein the music box is connected to the power means.

5. A fiber optic Christmas tree as set forth in claim 2 and further including a plurality of apertures formed in the housing.

* * * * *